US005900861A

United States Patent [19]

Nickerson et al.

[11] Patent Number: 5,900,861

[45] Date of Patent: May 4, 1999

[54] TABLE-DRIVEN COLOR CONVERSION USING INTERLEAVED INDICES

[75] Inventors: Brian R. Nickerson, Aloha; Chunrong Zhu, Portland, both of Oreg.

[73] Assignee: Intel Corporation, Santa Clara, Calif.

[21] Appl. No.: 08/534,957

[22] Filed: Sep. 28, 1995

[51] Int. Cl.[6] ..... G09G 1/28

[52] U.S. Cl. ..... 345/153; 345/154; 345/199; 348/488

[58] Field of Search ..... 345/105–155, 345/431, 432, 199; 348/649, 651, 659, 660, 396, 488; 382/162, 163, 167; 358/520, 457

[56] References Cited

U.S. PATENT DOCUMENTS

| | | | |
|---|---|---|---|
| 4,743,959 | 5/1988 | Frederiksen . | |
| 4,775,858 | 10/1988 | Stapleton et al. . | |
| 4,857,992 | 8/1989 | Richards . | |
| 4,868,764 | 9/1989 | Richards . | |
| 4,991,122 | 2/1991 | Sanders . | |
| 5,068,644 | 11/1991 | Batson et al. . | |
| 5,124,688 | 6/1992 | Rumball . | |
| 5,138,303 | 8/1992 | Rupel . | |
| 5,142,273 | 8/1992 | Wobermin . | |
| 5,204,664 | 4/1993 | Hamakawa . | |
| 5,218,431 | 6/1993 | Gleicher et al. . | |
| 5,218,432 | 6/1993 | Wakeland . | |
| 5,220,410 | 6/1993 | Wakeland et al. . | |
| 5,233,684 | 8/1993 | Ulichney . | |
| 5,258,826 | 11/1993 | Wakeland et al. . | |
| 5,329,292 | 7/1994 | Nishioka et al. . | |
| 5,341,442 | 8/1994 | Barrett . | |
| 5,381,180 | 1/1995 | Keith . | |
| 5,384,582 | 1/1995 | Keith et al. . | |
| 5,406,310 | 4/1995 | Aschenbrenner et al. . | |
| 5,416,614 | 5/1995 | Crawford . | |
| 5,428,465 | 6/1995 | Kanamori et al. . | |
| 5,428,720 | 6/1995 | Adams, Jr. . | |
| 5,430,465 | 7/1995 | Sabella et al. . | |
| 5,450,098 | 9/1995 | Oz . | |
| 5,506,604 | 4/1996 | Nally et al. | 345/154 |
| 5,519,439 | 5/1996 | Keith | 345/155 |
| 5,598,186 | 1/1997 | Edgar | 345/154 |
| 5,604,514 | 2/1997 | Hancock | 345/154 |
| 5,668,896 | 9/1997 | Winkelman | 345/154 |

OTHER PUBLICATIONS

"Direct–to–Palette Dithering", by IBM Corp., an IBM Technical Disclosure Bulletin, vol. 37 No. 3 Mar. 1994, p. 95.

Default RGB Color Palette with Simple Conversion from YUV, by IBM Corp., an IBM Technical Disclosure Bulletin, vol. 33 No. 5 Oct. 1990, pp. 200–205.

IEEE Transactions on Consumer Electronics, vol. 37, Issue 3, Aug. 1991, pp. 182–189, "Single–Chip Video Processing System," by Hans–Jürgen Désor.

*Primary Examiner*—Richard A. Hjerpe
*Assistant Examiner*—M. Fatahiyar
*Attorney, Agent, or Firm*—William H. Murray

[57] ABSTRACT

Image signals are converted from one color format to another using a lookup table based on interleaved indices generated from the components in the first color format. In a preferred embodiment, image signals in a YUV format are converted to image signals in a CLUT format by interleaving bits from the U and V components and appending bits from the Y component. By interleaving the U and V components, cache efficiency is improved when color conversion is implemented on a general-purpose processor with limited on-chip cache.

33 Claims, 2 Drawing Sheets

TABLE-DRIVEN COLOR CONVERSION USING INTERLEAVED INDICES

RELATED APPLICATIONS

This application is related to U.S. application Ser. No. 08/224,833, filed Apr. 8, 1994 as Attorney Docket No. 366403-982; U.S. application Ser. No. 08/236,230, filed Apr. 29, 1994 as Attorney Docket No. 366403-744; and U.S. application Ser. No. 08/425,709, filed Apr. 19, 1995 as Attorney Docket No. 366403-639W.

BACKGROUND OF THE INVENTION

1. Field of the Invention

The present invention relates to image processing, and, in particular, to computer-implemented processes, apparatuses, and computer programs for converting the color format of image signals.

2. Description of the Related Art

Different color formats are used to represent images in computer-based image processing systems. Standard computer monitors use a red-green-blue (RGB) color format for displaying image and graphics signals. For example, in RGB24 format, each image pixel is represented by three 8-bit component values representing the colors red, green, and blue, respectively. The RGB24 format Supports $2^{24}$ different colors.

Many computer operating systems, such as the Microsoft® Windows™ operating system, provide a palette of colors that are made available to applications running under those operating systems. The palette may be defined as a color lookup table (CLUT) which provides a mapping from a CLUT index to a particular RGB24 color. For example, 8-bit CLUT8 indices may be used to define and access up to 256 different colors in a lookup table. The particular colors in the CLUT may be defined by the operating system, an application running under the operating system, or both, such that the operating system may define and reserve some of the colors in the palette and allow applications to define the rest.

Another set of color formats used in image processing is based on the 3-component YUV color system, in which Y represents the luminance component and U and V represent chrominance components. The YUV color system is used extensively in image compression applications, because it has been found to provide greater degrees of compression than, for example, the RGB color system. One such color format is the YUV9 (or YUV4:1:1) format. In this color format, each (4×4) block of image pixels is represented by a (4×4) block of 8-bit Y components, a single 8-bit U component, and a single 8-bit V component. As a result, each (4×4) pixel block is represented by (16×8+8+8) or 144 bits, for an of 9 bits per pixel. Thus, the name YUV9. Like the RGB24 format, the YUV9 format provides 224 different colors.

When decompressing YUV9 images for display on an RGB24 monitor, the decoded signals are preferably converted from YUV9 format to a CLUT format. The CLUT signals may then be transmitted to the graphics adapter card which uses the CLUT to convert the signals from CLUT8 format to RGB24 format for display on the monitor. What is needed is an efficient method for converting image signals from YUV9 format to CLUT format.

It is accordingly an object of this invention to provide an efficient method for converting image signals from YUV9 format to CLUT format. 10 Further objects and advantages of this invention will become apparent from the detailed description of a preferred embodiment which follows.

SUMMARY OF THE INVENTION

The present invention comprises computer-implemented processes, apparatuses, and storage mediums for converting image signals. According to a preferred embodiment, an image signal is provided in a first color format, wherein the image signal corresponds to an image pixel and comprises two or more components. An interleaved index is generated for the image signal from the two or more components, wherein bits from at least two of the components are interleaved in the interleaved index. The image signals are converted from the first color format to a second color format by retrieving the image signal in the second color format from a lookup table using the interleaved index.

BRIEF DESCRIPTION OF THE DRAWINGS

Other objects, features, and advantages of the present invention will become more fully apparent from the following detailed description of the preferred embodiment, the appended claims, and the accompanying drawings in which:

DESCRIPTION OF THE PREFERRED EMBODIMENT(S)

The present invention is directed to the conversion of image signals from one color format to another color format. In a preferred embodiment, image signals in YUV9 format are converted to CLUT8 format. The CLUT8 signals may then be transmitted to a computer monitor for conversion to signals in RGB24 format for display.

Figure 1:
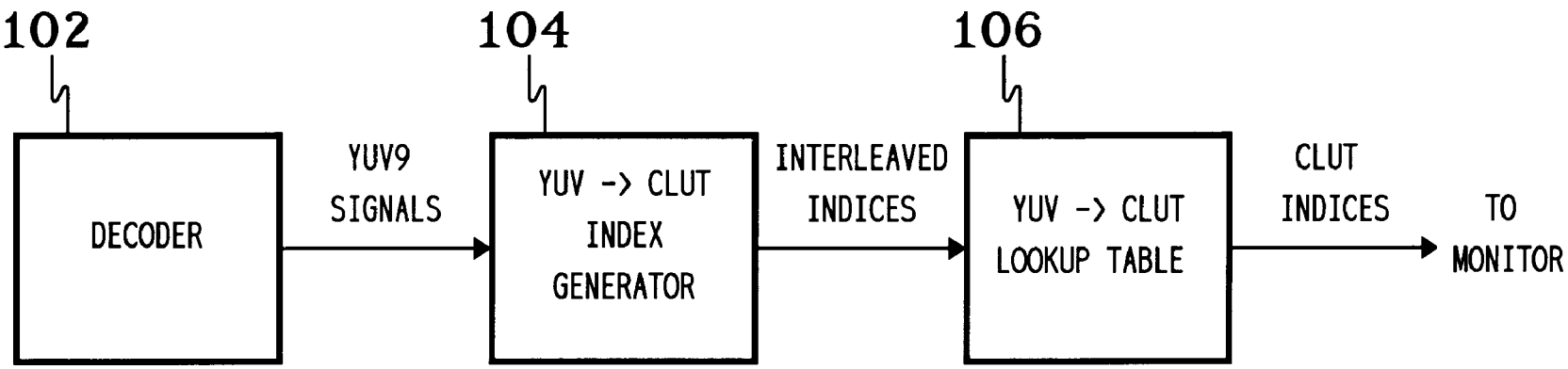
FIG. 1 is a block diagram of an image processing system that converts image signals from YUV9 format to CLUT8 format, according to a preferred embodiment of the present invention.
Figure 2:
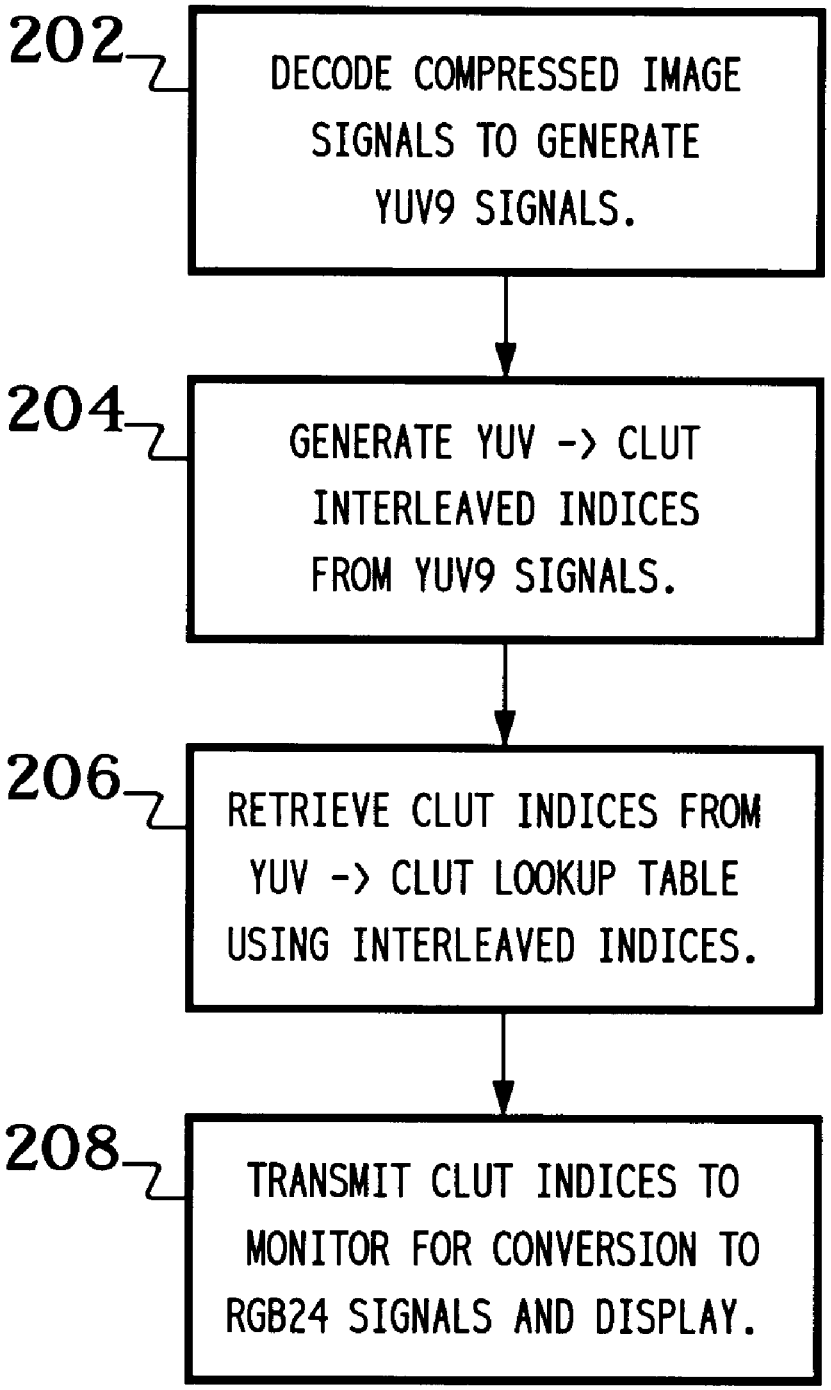
FIG. 2 is a flow chart of the processing implemented by the system of FIG. 1.

Referring now to FIGS. 1 and 2, there are shown, respectively, a block diagram of an image processing system 100 that converts image signals from YUV9 format to CLUT8 format and a flow chart of the processing implemented by system 100, according to a preferred embodiment of the present invention. System 100, which is preferably implemented in software on an Intel® Pentium Tm™ processor, is also preferably used to process sequences of video images, although it may also be adapted to process sets of one or more still images.

Decoder 102 of FIG. I decodes compressed image signals to generate image signals in YUV9 format (step 202 of FIG. 2). For each (4×4) block of each image, decoder 102 generates a (4×4) block of 8-bit Y components, a single 8-bit U component, and a single 8-bit V component. Each 8-bit Y component may be represented as $(y_7y_6y_5Y_4y_3y_2y_1y_0)$, each 8-bit U component as $(u_7u_6u_5u_4u_3u_2u_1u_0)$, and each 8-bit V component may be represented as $(v_7v_6v_5v_4v_3v_2v_1v_0)$, where $y_0$, $u_0$, and $v_0$ are the least significant bits (LSBs) of the components.

YUV→CLUT index generator 104 generates interleaved indices from the YUV9 signals, where each interleaved index comprises the following 16-bit sequence:

$$(u_7v_7u_6v_6u_5v_5u_4v_4y_7y_6y_5y_4y_3y_2y_1y_0)$$

(step 204). Since the U and V components are the same for all 16 pixels in a (4×4) block, index generator 104 preferably generates the upper byte $(u_7v_7u_6v_6u_5v_5u_4v_4)$ once and append lower byte $(y_7y_6y_5y_4y_3y_2y_1y_0)$ for the Y component of each different pixel in the block. Those skilled in the art will understand that the present invention covers alternative sequences for interleaved indices as well, such as, for example:

$(v_7u_7v_6u_6v_5u_5v_4u_4y_7y_6y_5y_4y_3y_2y_1y_0)$.

In a preferred embodiment, index generator 104 accesses a 256-byte lookup table to retrieve the upper byte $(u_7v_7u_6v_6u_5v_5u_4v_4)$ using $(u_7u_6u_5u_4v_7v_6v_5v_4)$ sa an index. An alternative preferred method is to use two 16-byte lookup tables: one that maps $(u_7u_6u_5u_4)$ to $(u_7\mathbf{0}\ u_6\mathbf{0}\ u_5\mathbf{0}\ u_4\mathbf{0})$ and another that maps $(v_7v_6v_5v_4)$ to $(\mathbf{0}\ v_7\mathbf{0}\ v_6\mathbf{0}\ v_5\mathbf{0}\ v_4)$ and then combines (i.e., ORs or ADDs) the two 8-bit fields to generate the upper byte $(u_7v_7u_6v_6u_5v_5u_4v_4)$. Yet another alternative preferreed method is to use two 256-byte lookup tables: one that maps $(u_7u_6u_5u_4u_3u_2u_1u_0)$ to $(u_7\mathbf{0}\ u_6\mathbf{0}\ u_5\mathbf{0}\ u_4\mathbf{0})$ and another that maps $(v_7v_6v_5v_4v_3v_2v_1v_0)$ to $(\mathbf{0}\ v_7\mathbf{0}\ v_6\mathbf{0}\ v_5\mathbf{0}\ v_4)$ and then combines the two 8-bit fields to generate the upper byte $(u_7v_7u_6v_6u_5v_5u_4v_4)$. Those skilled in the art will understand that using lookup tables to generate the interleaved upper byte may be faster to implement than manipulating the individual bits using such operations as shifting and/or masking.

YUV→CLUT lookup table 106 is then accessed using the 16-bit interleaved indices to retrieve the corresponding CLUT8 indices (step 206). Lookup table 106, which contains $2^{16}$ or 64 K entries, maps the 16-bit interleaved indices to the corresponding CLUT8 indices. The retrieved CLUT8 indices, one for each pixel, are then transmitted to a computer monitor for conversion from CLUT8 format to RGB24 format for display (step 208). The graphics adapter card (not shown) of the computer monitor uses a CLUT→RGB lookup table to convert the signals from CLUT8 format to RGB24 format. The CLUT→RGB lookup table, which contains $2^8$ or 256 entries, maps the 8-bit CLUT8 indices to the corresponding RGB24 signals.

For a number of reasons, the present invention provides for efficient conversion of image signals for display. Although there are known equations for converting from YUV color space directly to RGB color space, the computational loads involved in implementing these computational conversions may be too great for some applications, especially where the conversion is to be implemented in real-time on a general-purpose processor. By using a sequence of lookup tables, large numbers of pixels can be converted from one color format to another in a relatively short period of time.

In addition, since YUV9→CLUT8 conversion is preferably performed on the host processor and CLUT8→RGB24 conversion is preferably performed on the graphics adapter card, only one 8-bit CLUT8 index is transmitted from the host processor to the monitor for each pixel, rather than 24 bits of the RGB24 format. This provides faster transfer of image data from the host processor to the monitor.

The preferred conversion scheme of FIGS. 1 and 2 retains sufficient precision in the color components. The preferred scheme uses all of the available bits of the Y components as well as the four most significant bits (MSBs) of the U and V components. All of the Y bits are used since the eye is very sensitive to changes in intensity. Since the eye is less perceptive of changes in U and V, acceptable image quality is achieved even though the four LSBs of U and V are ignored.

In the preferred scheme of FIGS. 1 and 2, the U and V components contribute only to the upper byte of the interleaved indices and the Y components contributes only to the lower byte. This separation into distinct bytes provides for more efficient processing on a general-purpose processor such as an Intel® Pentium™ processor which has predefined instructions for accessing the lower two bytes of the processor registers.

Another area of efficiency provided by the present invention relates to the use of the on-chip cache. The lookup tables for the scheme of FIGS. 1 and 2 are too large (over 64 Kbytes) to fit within the 8 K on-chip cache of an Intel® Pentium™ processor Whenever a new location of the lookup table is accessed, the processor loads a corresponding region of the lookup table into the on-chip cache from external (i.e., off-chip) memory. This is slower than accessing a region of the lookup table that is already loaded into the on-chip cache. Cache efficiency refers to the frequency with which the on-chip cache is accessed without having to load new data from external memory. Higher cache efficiency generally implies more efficient processing.

By placing the U and V contributions to the interleaved indices in the upper byte, the upper byte is guaranteed to stay constant for at least 16 pixels in a row (where the conversion is performed on a (4×4) block by block basis). Even if the Y components change from pixel to pixel within a (4×4) block, the upper byte of the different interleaved indices remains constant, which means that the same 256-byte region of the lookup table are accessed at least 16 times in a row. This implies efficient use of the on-chip cache by reducing the frequency with which the processor has to read additional regions of the lookup table from external memory.

Cache efficiency is improved even more by interleaving the bits from the U and V components when generating the upper byte of the interleaved indices. If the U and/or V components vary only slightly from block to block, then using interleaved indices will provide greater overall cache efficiency than if the indices are not interleaved. In the non-interleaved case, the index may be defined as follows:

$(u_7u_6u_5u_4v_7v_6v_5v_4y_7y_6y_5y_4y_3y_2y_1y_0)$.

Assume, for example, that, in going from one block to the next, the $u_4$ bit changes, but that the rest of the bits of U and V stay the same. In that case, the new non-interleaved index will be about $2^{12}$ or 4 K bytes away from the previous non-interleaved index. Using interleaved indices, the new index would only be about $2^9$ or 512 bytes away from the previous index. Since the indices are closer together, the chances that the location of the lookup table corresponding to the new index is already loaded into the on-chip cache are greater and cache efficiency is therefore higher.

In sum, the claimed invention provides efficient conversion from one color format to another by using fast lookup tables with efficient use of the on-chip cache.

In a preferred embodiment, the present invention is implemented on an Intel® Pentium™ processor. In alternative embodiments, other processors may be used.

In some preferred embodiments of the present invention, the U and V components are dithered to improve the quality of the displayed images. This dithering may provide an effective precision of 5 bits for the U and V planes. Dithering may also adversely affect the cache efficiency by changing the U and V components within a (4×4) block. Since these changes are typically small, however, the impact to cache efficiency will be minimal.

In a preferred embodiment, the CLUT→RGB lookup table is predefined by the operating system and/or by an application. In alternative embodiments, the CLUT→RGB lookup table may be defined in other ways, e.g., generated at run time by an application. Similarly, the YUV→CLUT lookup table may be predefined or even adaptively defined at run time by the application.

In a preferred embodiment, image signals are converted from YUV9 format to CLUT8 format for conversion to RGB24 format. In alternative embodiments, combinations of other color formats may be used.

The present invention can be embodied in the form of computer-implemented processes and apparatuses for practicing those processes. The present invention can also be embodied in the form of computer program code embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. A computer-implemented process for converting image signals, comprising the steps of:

(a) providing an image signal in a first color format, wherein the image signal corresponds to an image pixel and comprises three components;

(b) generating an interleaved index for the image signal from two or more components, wherein bits from at least two of the three components alternate with each other in the interleaved index, individually; and (c) converting the image signals from the first color format to a second color format by retrieving the image signal in the second color format from a first lookup table using the interleaved index.

2. The process of claim 1, wherein the first color format is a YUV format and the second color format is a CLUT format.

3. The process of claim 2, wherein the U and V components are dithered and bits from the dithered U and V components are interleaved in the interleaved index.

4. A computer-implemented process for converting image signals, comprising the steps of:

(a) providing an image signal in a first color format, wherein the image signal corresponds to an image pixel and comprises two or more components;

(b) generating an interleaved index for the image signal from the two or more components, wherein bits from at least two of the components are interleaved in the interleaved index, and the interleaved index comprises a 16 bit sequence from the group consisting of:

(uvuvuvuv yyyyyyyy) and (vuvuvuvu yyyyyyyy), wherein each u represents a different bit of a U component, each v represents a different bit of a V component, and each y represents a different bit of a Y component; and (c) converting the image signals from the first color format to a second color format by retrieving the image signal in the second color format from a first lookup table using the interleaved index.

5. The process of claim 2, wherein the first color format is a YUV9 format and the second color format is a CLUT8 format.

6. The process of claim 1, further comprising the step of:

(d) processing the image signals in the second color format for display.

7. The process of claim 6, wherein step (d) comprises the step of converting the image signals from the second color format to a third color format.

8. The process of claim 7, wherein the second color format is a CLUT format and the third color format is an RGB format.

9. The process of claim 1, wherein step (b) comprises the step of generating the interleaved index by accessing one or more additional lookup tables using bits of the at least two components as indices.

10. The process of claim 9, wherein step (b) comprises the steps of:

(1) accessing a first-component lookup table using bits of a first component to generate a first field;

(2) accessing a second-component lookup table using bits of a second component to generate a second field;

(3) combining the first and second fields to generate an interleaved field; and (4) combining the interleaved field with bits of a third component to generate the interleaved index.

11. The process of claim 1, wherein:

the first color format is a YUV9 format;

the second color format is a CLUT 8 format;

the interleaved index comprises a 16 bit sequence from the group consisting of:

(uvuvuvuv yyyyyyyy) and (vuvuvuvu yyyyyyyy), wherein each u represents a different bit of the U component, each v represents a different bit of the V component, and each y represents a different bit of the Y component;

step (b) comprises the steps of:

(1) accessing a U-component lookup table using bits of the U component to generate a U field;

(2) accessing a V-component lookup table using bits of the V component to generate a V field;

(3) combining the U and V fields to generate an interleaved field; and (4) combining the interleaved field with bits of the Y component to generate the interleaved index; and further comprising the step of converting the image signals in the CLUT8 format to image signals in an RGB24 format for display.

12. An apparatus for converting image signals, comprising:

(a) means for providing an image signal in a first color format, wherein the image signal corresponds to an image pixel and comprises three components;

(b) means for generating an interleaved index for the image signal from two or more components, wherein bits from at least two of the three components alternate with each other in the interleaved index, individually; and (c) means for converting the image signals from the first color format to a second color format by retrieving the image signal in the second color format from a first lookup table using the interleaved index.

13. The apparatus of claim 12, wherein the first color format is a YUV format and the second color format is a CLUT format.

14. The apparatus of claim 13, wherein the U and V components are dithered and bits from the dithered U and V components are interleaved in the interleaved index.

15. A computer-implemented process for converting image signals, comprising the steps of:

(a) means for providing an image signal in a first color format, wherein the image signal corresponds to an image pixel and comprises two or more components;

(b) means for generating an interleaved index for the image signal from the two or more components, wherein bits from at least two of the components are interleaved in the interleaved index, and the interleaved index comprises a 16 bit sequence from the group consisting of:

(uvuvuvuv yyyyyyyy) and (vuvuvuvu yyyyyyyy), wherein each u represents a different bit of a U component, each v represents a different bit of a V component, and each y represents a different bit of a Y component; and (c) means for converting the image signals from the first color format to a second color format by retrieving the image signal in the second color format from a first lookup table using the interleaved index.

16. The apparatus of claim 13, wherein the first color format is a YUV9 format and the second color format is a CLUT8 format.

17. The apparatus of claim 12, further comprising:

(d) means for processing the image signals in the second color format for display.

18. The apparatus of claim 17, wherein means (d) converts the image signals from the second color format to a third color format.

19. The apparatus of claim 18, wherein the second color format is a CLUT format and the third color format is an RGB format.

20. The apparatus of claim 12, wherein means (b) generates the interleaved index by accessing one or more additional lookup tables using bits of the at least two components as indices.

21. The apparatus of claim 20, wherein means (b):

(1) accesses a first-component lookup table using bits of a first component to generate a first field;

(2) accesses a second-component lookup table using bits of a second component to generate a second field;

(3) combines the first and second fields to generate an interleaved field; and (4) combines the interleaved field with bits of a third component to generate the interleaved index.

22. The apparatus of claim 12, wherein:

the first color format is a YUV9 format;

the second color format is a CLUT 8 format;

the interleaved index comprises a 16 bit sequence from the group consisting of:

(uvuvuvuv yyyyyyyy) and (vuvuvuvu yyyyyyyy), wherein each u represents a different bit of the U component, each v represents a different bit of the V component, and each y represents a different bit of the Y component;

means (b):

(1) accesses a U-component lookup table using bits of the U component to generate a U field;

(2) accesses a V-component lookup table using bits of the V component to generate a V field;

(3) combines the U and V fields to generate an interleaved field; and (4) combines the interleaved field with bits of the Y component to generate the interleaved index; and further comprising means for converting the image signals in the CLUT8 format to image signals in an RGB24 format for display.

23. A storage medium encoded with machine-readable computer program code for converting image signals, comprising:

(d) means for causing a computer to provide an image signal in a first color format, wherein the image signal corresponds to an image pixel and comprises three components;

(e) means for causing the computer to generate an interleaved index for the image signal from two or more components, wherein bits from at least two of the three components alternate with each other in the interleaved index, individually; and (f) means for causing the computer to convert the image signals from the first color format to a second color format by retrieving the image signal in the second color format from a first lookup table using the interleaved index.

24. The storage medium of claim 23, wherein the first color format is a YUV format and the second color format is a CLUT format.

25. The storage medium of claim 24, wherein the U and V components are dithered and bits from the dithered U and V components are interleaved in the interleaved index.

26. A computer-implemented process for converting image signals comprising the steps of:

(a) means for causing the computer to provide an image signal in a first color format, wherein the image signal corresponds to an image pixel and comprises two or more components;

(b) means for causing the computer to generate an interleaved index for the image signal from the two or more components, wherein bits from at least two of the components are interleaved in the interleaved index, and the interleaved index comprises a 16 bit sequence from the group consisting of:

(uvuvuvuv yyyyyyyy) and (vuvuvuvu yyyyyyyy), wherein each u represents a different bit of a U component, each v represents a different bit of a V component, and each y represents a different bit of a Y component; and (c) means for causing the computer to convert the image signals from the first color format to a second color format by retrieving the image signal in the second color format from a first lookup table using the interleaved index.

27. The storage medium of claim 24, wherein the first color format is a YUV9 format and the second color format is a CLUT8 format.

28. The storage medium of claim 23, further comprising:

(d) means for causing the computer to process the image signals in the second color format for display.

29. The storage medium of claim 28, wherein means (d) causes the computer to convert the image signals from the second color format to a third color format.

30. The storage medium of claim 29, wherein the second color format is a CLUT format and the third color format is an RGB format.

31. The storage medium of claim 23, wherein means (b) causes the computer to generate the interleaved index by accessing one or more additional lookup tables using bits of the at least two components as indices.

32. The storage medium of claim 31, wherein means (b) causes the computer to:

(1) access a first-component lookup table using bits of a first component to generate a first field;

(2) access a second-component lookup table using bits of a second component to generate a second field;

(3) combine the first and second fields to generate an interleaved field; and (4) combine the interleaved field with bits of a third component to generate the interleaved index.

33. The storage medium of claim 23, wherein:

the first color format is a YUV9 format;

the second color format is a CLUT8 format;

the interleaved index comprises a 16 bit sequence from the group consisting of:

(uvuvuvuv yyyyyyyy) and (vuvuvuvu yyyyyyyy), wherein each u represents a different bit if the U component, each v represents a different bit of the V component, and each y represents a different bit of the Y component;

means (b) causes the computer to:

(1) access a U-component lookup table using bits of the U component to generate a U field;

(2) access a V-component lookup table using bits of the V component to generate a V field;

(3) combine the U and V fields to generate an interleaved field; and (4) combine the interleaved field with bits of the Y component to generate the interleaved index; and further comprising means for causing the computer to convert the image signals in the CLUT8 format to image signals in an RGB24 format for display.

* * * * *